US008016698B2

(12) United States Patent
Cameron

(10) Patent No.: US 8,016,698 B2
(45) **Date of Patent: *Sep. 13, 2011**

(54) GOLF BALL MARKER

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/177,174

(22) Filed: Jul. 22, 2008

(65) Prior Publication Data

US 2009/0305818 A1 Dec. 10, 2009

Related U.S. Application Data

(63) Continuation-in-part of application No. 12/134,399, filed on Jun. 6, 2008.

(51) Int. Cl.
*A63B 57/00* (2006.01)

(52) U.S. Cl. ..... 473/406; 473/257

(58) Field of Classification Search ..... 473/286, 473/406, 257, 220; D21/793, 794
See application file for complete search history.

(56) References Cited

U.S. PATENT DOCUMENTS

| | | | | | |
|---|---|---|---|---|---|
| 1,735,736 | A | * | 11/1929 | Davidson | 473/406 |
| 2,107,944 | A | * | 2/1938 | Howard | 473/406 |
| 3,041,071 | A | | 6/1962 | Fialon | |
| 4,521,018 | A | * | 6/1985 | Cotchonis | 473/406 |
| 5,295,683 | A | * | 3/1994 | Tate | 473/406 |
| 5,356,133 | A | * | 10/1994 | Bellagamba | 473/406 |
| 5,437,446 | A | * | 8/1995 | Youngkin | 473/406 |
| 5,449,176 | A | * | 9/1995 | Schwab, Jr. | 473/268 |
| 5,476,258 | A | | 12/1995 | Frisone | |
| D405,858 | S | * | 2/1999 | Wolff | D21/759 |
| 6,074,311 | A | * | 6/2000 | Froud et al. | 473/406 |
| D428,954 | S | * | 8/2000 | Tate | D21/793 |
| D445,160 | S | * | 7/2001 | Hueber | D21/794 |
| 6,394,916 | B1 | * | 5/2002 | Doucettperry | 473/406 |
| 6,739,980 | B2 | | 5/2004 | Scott et al. | |
| D520,588 | S | * | 5/2006 | Morgan | D21/794 |
| 7,120,972 | B2 | * | 10/2006 | O' Banion | 24/303 |
| D583,893 | S | * | 12/2008 | Ruff | D21/794 |
| D588,226 | S | * | 3/2009 | Brown | D21/794 |
| 2005/0026727 | A1 | | 2/2005 | Barouh | |

OTHER PUBLICATIONS

"Putting Tools" from Golf by Colors, www.puttingtool.com/live/, 2 pages, Apr. 30, 2009.
"Using Your Ball Marker," www.vbsa.org.au/Referees, 2 pages, Jun. 3, 2008.
"Tools of the Trade," www.prosnookerref.co.uk/tools_of the_trade.php, 2 pages, 2006.
"Image Gallery," www.prosnookerref.co.uk/images.php 3 pages, 2006.

* cited by examiner

*Primary Examiner* — Steven Wong
(74) *Attorney, Agent, or Firm* — Michael J. Mancuso

(57) ABSTRACT

A golf ball marker that includes a body having a geometric shape and an arcuate ball location reference for easily positioning a golf ball. The body may also include alignment indicia for aligning the golf ball with an intended ball path.

18 Claims, 3 Drawing Sheets

GOLF BALL MARKER

CROSS-REFERENCE TO RELATED APPLICATIONS

This is a continuation-in-part of U.S. patent application Ser. No. 12/134,399, filed on Jun. 6, 2008, now pending, the disclosure of which is incorporated herein by reference in its entirety.

FIELD OF THE INVENTION

This invention generally relates to golf accessories, and more specifically to a golf ball marker.

BACKGROUND OF THE INVENTION

During a round of golf, players awaiting their turn on a green and players wishing to remove their ball from the surface of the green, such as for cleaning and/or alignment, place a ball marker adjacent their ball so that the ball may be returned to that position. Oftentimes players utilize common small objects, such as coins, as ball markers.

Some ball markers incorporate features that aid a golfer in the alignment of their ball and putting stroke. Generally those markers include a disk coupled to an end of an elongate projection and one or more sight lines, or arrows, oriented in a single direction. During use, the projection is inserted into the putting surface and the disk is rotated to indicate the direction of a desired ball path. Because those markers only indicate a single direction of alignment, players often perform multiple iterations of orienting the alignment device and stepping back to view the orientation. Alternatively, players perform multiple steps of placing the ball and confirming the alignment, such as with an alignment marking included on the ball. In either case, the iterative process slows the speed of play.

It is desired to provide a ball marker that provides a more efficient alignment mechanism.

SUMMARY OF THE INVENTION

The invention is directed to a golf ball marker that allows a user to align and re-align intended ball paths without requiring movement of the marker and regardless of the presence, or absence, of a golf ball. Additionally, the present invention allows the user to align an alignment mark of a golf ball with at least one of a plurality of alignment marks on the ball marker by rotating the golf ball about the center of the golf ball while the ball marker remains stationary and the golf ball remains properly located. Several embodiments of the present invention are described below.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to a golf ball marker. Several embodiments of the present invention are described below.

Figure 1:
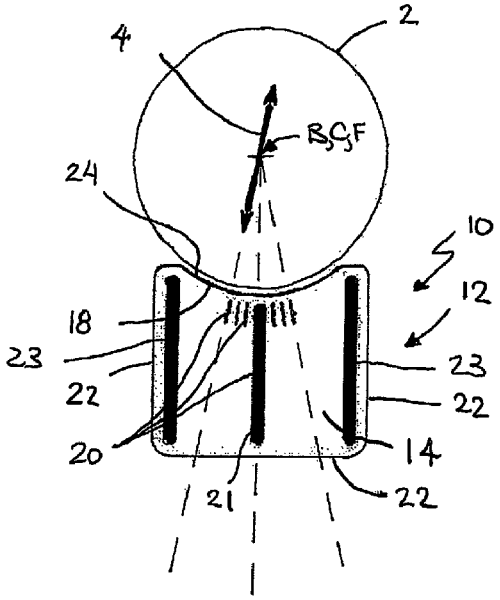
FIG. 1 is a top view of a golf ball marker of the present invention.
Figure 2:
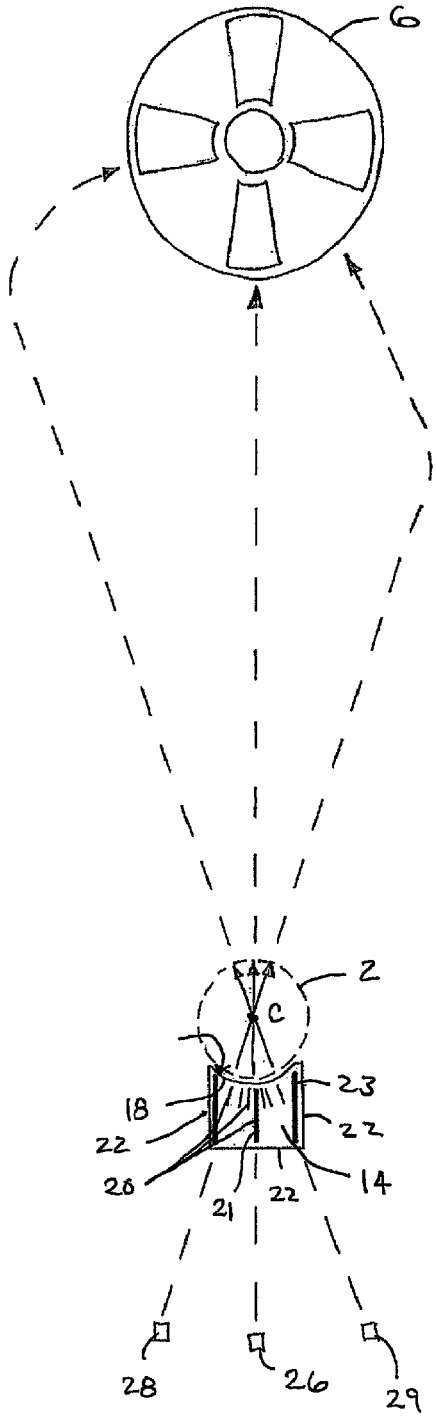
FIG. 2 is a schematic view illustrating use of the marker of FIG. 1.

An embodiment of a golf ball marker 10 includes a body 12 having a geometric perimeter shape and including a top surface 14, a bottom surface 16 (shown in FIG. 7), an arcuate ball location reference 18 and a plurality of alignment indicia 20, as shown in FIGS. 1 and 2. Body 12 has a generally square perimeter shape and a thickness defined by a plurality of side walls 22 extending between top surface 14 and bottom surface 16 and may be constructed from any rigid metallic or non-metallic material. Top surface 14 and bottom surface 16 are generally planar surfaces. Top surface 14 includes alignment indicia 20 and bottom surface 16 provides a stable ground contacting platform so that marker 10 is stable when placed on a putting surface. The thickness of body 12 is preferably in a range of 0.050 inch to 0.250 inch, and more preferably approximately 0.125 inch. The length of each of the sides of the generally square body 12 is in a range of 0.75 inch to 1.50 inches, and preferably in a range of approximately 1.00 inch to 1.25 inches, and more preferably approximately 1.201 inches. Additionally, the corners and edges of the body are preferably radiused to reduce the sharp feel of the intersecting surfaces. Preferably, the corners and edges are radiused by 0.040 inch to 0.250 inch.

In the present embodiment, body 12 includes an arcuate side wall so that marker 10 includes an arcuate side surface 24. Arcuate side surface 24 intersects top surface 14 forming an arcuate edge that is an arcuate ball location reference 18. Arcuate side surface 24 is a cylindrical surface that is approximately perpendicular to top surface 14 and the radius of curvature is approximately 0.840 inch. The radius of curvature of ball location reference 18 is preferably in a range of 0.725 inch to 0.975 inch.

During a round, a user places marker 10 adjacent golf ball 2 so that, when viewed from above, the arcuate ball location reference 18 approximately matches, or is approximately parallel to, the curvature of the outer surface of golf ball 2. When marker 10 is placed in that position, the center of curvature C of ball location reference 18 is approximately aligned vertically with the center B of ball 2. As a result, ball location reference 18 allows a golfer to easily and accurately replace golf ball 2 to its original location after ball 2 simply by locating ball 2 relative to ball location reference 18.

Alignment indicia 20 are located on top surface 14. In the present embodiment, alignment indicia 20 are elongate, linear markings, a plurality of which are identical, that are perpendicular to ball location reference 18 so that they radiate from a focal point F that is coincident with the center of curvature C of ball location reference 18. Because of that orientation, when ball 2 is located relative to ball location reference 18, as described above, focal point F is also approximately vertically aligned with the center B of golf ball 2. Preferably, alignment indicia are rotated relative to each other about the focal point F by a predetermined constant angle that may be between 1° and 10° . For example, each of the alignment indicia may be rotated relative to the next adjacent indicium, or indicia, by a constant angle, such as 5°.

Alignment indicia 20 may have various lengths and widths. For example, marker 10 includes a central indicium 21 that has a length that is approximately equal to the length of the center portion of body 12; optional parallel indicia 23 that are parallel to central indicium 21 and spaced laterally therefrom, adjacent the side surfaces of body 12; and a plurality of smaller reference indicia. Preferably the width of the central indicium and any parallel indicia is approximately twice the width of the reference indicia. For example, the width of the central indicium and parallel indicia is approximately 0.078 inch and the width of each of the reference indicia is approximately 0.030 inch. Additionally, the lengths of the central and parallel indicia are preferably in a range of 0.750 inches to 1.500 inches and more preferably in a range of 1.000 inch to 1.25 inches. The length of each of the reference indicia is preferably in a range of 0.063 inch to 0.500 inch and more preferably approximately 0.330 inch. As a result, the length of each of the reference indicia is preferably less than half the length of the central or parallel indicia, and more preferably less than one third the length of the central or parallel indicia.

Alternatively, the alignment indicia may be one or a plurality of dots, letters or symbols, such as diamonds, stars, asterisks, arrowheads, dashes, triangles, "$", "#" and/or chevrons, and each of the indicia is preferably spaced perpendicularly away from ball location reference 18 by a constant amount. Additionally, the alignment indicia may be painted on the top surface; machined into the top surface of the marker. The alignment indicia may be inlaid with a different material than the remainder of the marker. As a further feature the elongate central indicium and/or the elongate parallel indicia may be constructed from a plurality of marks, such as dots and/or symbols, aligned with and adjacent or overlapping each other. It should be appreciated that any or all of the indicia may be located so that they intersect the ball location reference, if desired. Furthermore, the indicia may be provided by a multi-piece laminate construction of the body where pieces included in the body have contrasting appearance. Still further the indicia may be created by inserting pins or screws through a portion of the body or by including weld lines on a surface of the body.

After a user places marker 10 and removes ball 2, marker 10 provides a clear reference to view different ball paths from a distance. For example, and as illustrated schematically in FIG. 2, the user initially places the marker so that a central indicium 21 is aligned with an initial orientation, such as towards hole 6. Then, the user removes their ball from the putting surface and views alternative ball paths from alternative positions 26, 28, 29 that correspond to a plurality of ball paths extending through alignment indicia 20. Because of the location of focal point F, those paths also generally pass through the proper ball location. The user may then easily determine which indicia corresponds to a desired ball path for the contour of the putting surface.

When it is the user's turn to putt, the user easily replaces the ball 2 in the original location and aligns an alignment mark 4 included on ball 2 with an indicium 20 on marker 10 corresponding to the desired ball path. Finally, the marker may be removed and the ball remains in the proper position with the desired ball path, and putting stroke, indicated by alignment mark 4. Using the marker of the present invention, a golfer may easily determine a desired ball path without altering the position of the marker and without performing multiple steps of placing and confirming the alignment of a ball. Additionally, the player may determine a desired path from a distant location that does not interfere with other players even while those other players are putting.

Figure 3:
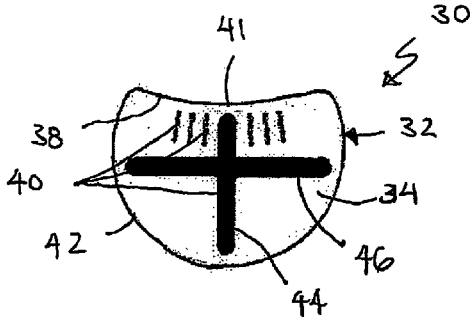
FIG. 3 is a top view of another embodiment of the ball marker of the present invention.

Referring to FIG. 3, another embodiment of a golf ball marker 30. Marker 30 includes body 32 having a generally curved, crescent perimeter shape and including a top surface 34, a bottom surface, an arcuate ball location reference 38 and a plurality of alignment indicia 40. Body 32 has a thickness defined by a concave arcuate side wall 41 and a convex arcuate side wall 42 extending between top surface 34 and the bottom surface. Similar to the previously described embodiment, concave arcuate side wall 41 is generally perpendicular to and intersects top surface 34 to form an arcuate edge that is ball location reference 38, which has a radius of curvature in a range of 0.725 inch to 0.975 inch.

Alignment indicia 40 are elongate markings located on top surface 34 that are perpendicular to ball location reference 38 so that they radiate from a focal point F that is coincident, or aligned vertically, with the center of curvature C of ball location reference 38. Indicia 40 include a central elongate indicium 44 and a lateral indicium 46 that intersects central indicium 44 so that indicia 44, 46 combine to form a cross.

It should be appreciated that the body of the ball marker may have any geometric perimeter shape. For example, the body may have a polygonal perimeter, such as a square, triangle or rectangle; a curved perimeter, such as a crescent; or a combined curved and polygonal perimeter.

Figure 4:
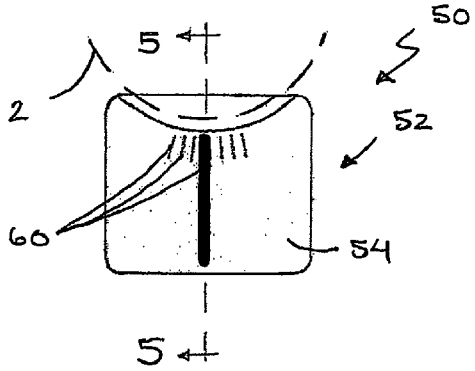
FIG. 4 is a top view of the ball marker of the present invention.

Alternate constructions of the arcuate ball location reference will be described with reference to FIGS. 4 and 5A-5C. Although the various embodiments have different constructions, shown in FIGS. 5A-5C, they share a common to view appearance, as shown in FIG. 4. Generally, marker 50 includes body 52 having a geometric shape and including a top surface 54, a bottom surface, an arcuate ball location reference and a plurality of alignment indicia 60.

Figure 5A:
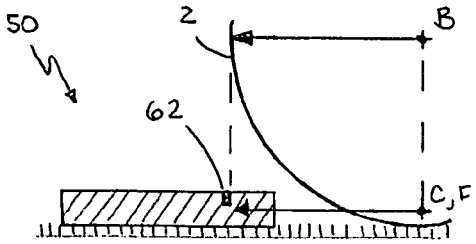
FIGS. 5A-5C are cross-sectional views of embodiments of ball markers.

In the embodiment of FIG. 5A, an arcuate ball location reference 62 is an arcuate marking provided on the top surface. For example, the marking may be a painted and/or engraved curve or the marking may be a machined groove extending into the body from the top surface, which may be optionally paint filled or inlaid.

Figure 5B:
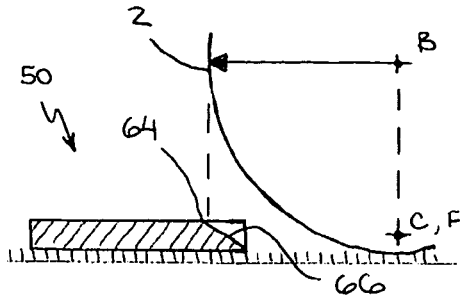

In another embodiment, shown in FIG. 5B, an arcuate ball location reference 64 is an arcuate edge formed at an intersection between a tapered arcuate surface 66 and the top surface. For example, arcuate surface 66 may be a conical surface or a spherical surface that intersects the top surface of the body of the ball marker.

Figure 5C:
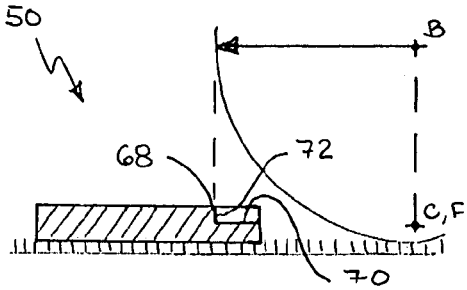

In another embodiment, an arcuate ball location reference 68 is an arcuate edge formed by a shoulder 72 between the top surface and a recessed reference surface 70, as shown in FIG. 5C. As shown, the recessed reference surface 70 intersects a side wall of the body, however, it should be appreciated that alternatively the recessed surface may form a cavity in the top surface of the body, which may be paint filled or inlaid for contrast with the remainder of the body and/or the ball.

It should be appreciated that any of the surfaces of the ball marker may be painted, chemically treated, plated, textured, or constructed using multiple materials to increase contrast between portions of the body and/or between the body and an adjacent golf ball. Additionally, alignment indicia may be provided on both the top and bottom surfaces of the marker if desired. Different markings may be provided on the top and bottom surfaces so that the user may easily distinguish the top surface from the bottom surface, especially in embodiments including a top surface and a bottom surface having similar shape. For example, customized logos or other customized or personalized markings may be included on any of the surfaces.

Figure 6:
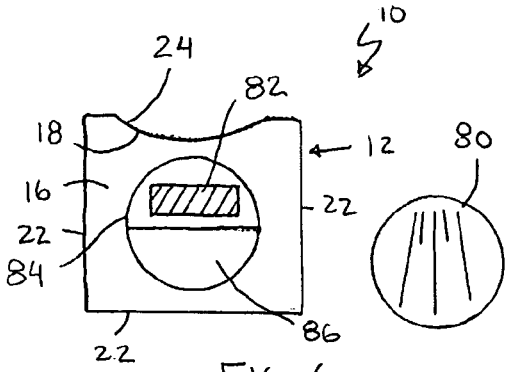
FIG. 6 is a bottom view of a golf ball marker that includes a secondary ball marker.

As an additional feature, ball marker 10 may provide a holder for a smaller secondary ball marker 80, as shown in FIG. 6. For example, secondary ball marker 80 may be constructed of a ferromagnetic material and a magnet 82 may be integrated into body 12 so that ball marker 80 may be easily, and removably, coupled to body 12. Additionally, a recess 84 that extends into body 12 from bottom surface 16 and sized and shaped to receive ball marker 80 may be provided so that ball marker 80 is flush with bottom surface 16 when received therein. As a further alternative, a second recess 86 may be provided within recess 84 so that ball marker 80 may be easily disengaged from magnet 82 by pressing the portion of ball marker 80 adjacent second recess 86. Secondary ball marker 80 may include additional markings that may include indicia and/or logos. For example, secondary ball marker 80 may be customized and multiple configurations of the secondary ball marker may be provided that all fit a common primary ball marker so that a custom ball marker 10 may be provided at reduced manufacturing costs.

Figure 7:
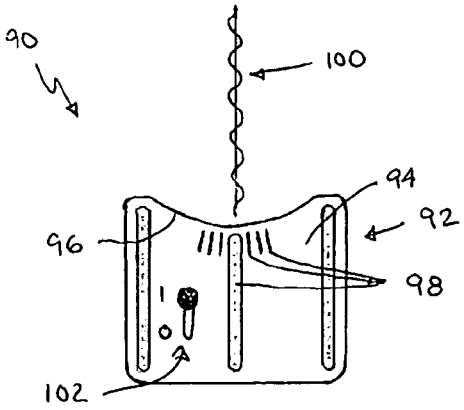
FIG. 7 is a top view of another embodiment of a golf ball marker of the present invention.

The ball marker may also include a focused light source so that the marker may be used as a training aid, as shown in FIG. 7. Ball marker 90, generally includes a body 92 that includes a top surface 94, a ball location reference 96, a plurality of alignment indicia 98 and a focused light source that emits a focused beam of light 100. For example, the light source may be a laser sight, or pointer, so that the alignment of the marker may be easily viewed. Electronics used in the light source may be housed within body 92 and a switch 102 may be accessible on any surface of body 92 so a user may easily turn the light source on and off. In the present embodiment, switch 102 is accessible on top surface 94 and is configured to be slid between an on position and an off position. During use, a user can align marker 90 in an initial orientation, such as toward a hole or practice cup, and use the light beam 100 to determine whether the initial placement of marker 90 actually corresponds to the desired alignment.

Figure 8:
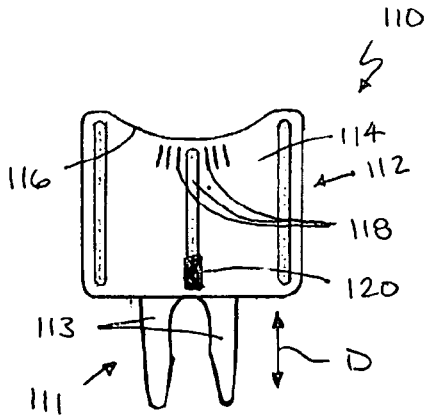
FIG. 8 is a top view of another embodiment of a golf ball marker of the present invention.

As shown in FIG. 8, a ball marker 110 may include an integrated divot tool 111. Generally, ball marker 110 includes a body 112 that includes a top surface 114, a ball location reference 116, a plurality of alignment indicia 118 and divot tool 111. Divot tool 111 includes a pair of prongs 113 that extend beyond the outer perimeter of body 112. In the present embodiment, divot tool 111 is slidably received in body 112 so that prongs 113 may be selectively extended from body 112 by the user. A slide 120 is provided on one of the surfaces of body 112, such as top surface 114, so that divot tool 111 may be extended and retracted in the direction D by a user. The length of prongs 113 is selected so that when divot tool 111 is retracted it is entirely housed within body 112. Additionally, slide 120 is preferably sized and shaped so that it slides within a central alignment indicia so that a user is not distracted during alignment of the ball marker. Alternatively, the divot tool may be non-retractable, such as by including prongs permanently extending from a side wall of the body of the ball marker.

The ball markers of the present invention may be constructed from any metallic or non-metallic material that is rigid or semi-rigid. For example, the ball markers may be made of aluminum, stainless steel, carbon steel, titanium, silver, platinum, gold, a polymeric material, glass, stone, wood, etc. As another alternative, the ball marker may have a multi-material construction as described below. The ball marker of the present invention, may be machined, molded, cast, forged, sintered, carved or constructed using any technique. Additionally, the ball marker may be constructed from multiple pieces forming a laminate construction and the pieces may be constructed from metallic and/or non-metallic. In such a laminate construction the pieces are mechanically coupled, such as by welding, mechanical fasteners and/or adhesives. At least a pair of the pieces of such a laminate construction may have contrasting appearance so that the contrasting appearance provide indicia. The ball marker may be constructed from a magnetic material or shaped to engage a magnetic or mechanical marker holder that is configured to clip onto or is integrated into the user's apparel, such as a hat, belt or belt buckle.

Additionally, the ball markers may include surface treatments, textures, coatings and/or platings to provide corrosion resistance or a desired finish. For example, the ball marker may be plated with one or more metals such as gold, silver or nickel; the ball marker may be anodized and colored; or the ball marker may be textured such as by bead-blasting, etc. Any indicia and/or any other markings included on the ball marker may be created by machining, engraving, painting and/or printing. Still further, the indicia and/or markings may be painted, paint filled, printed, textured, coated, plated and/or treated to have an appearance that differs from the remainder of the ball marker. Additionally, the indicia and/or markings may be inlaid with material that is different than the remainder of the body, such as wood, stone, metal, shell, reflective material, etc.

Figure 9:
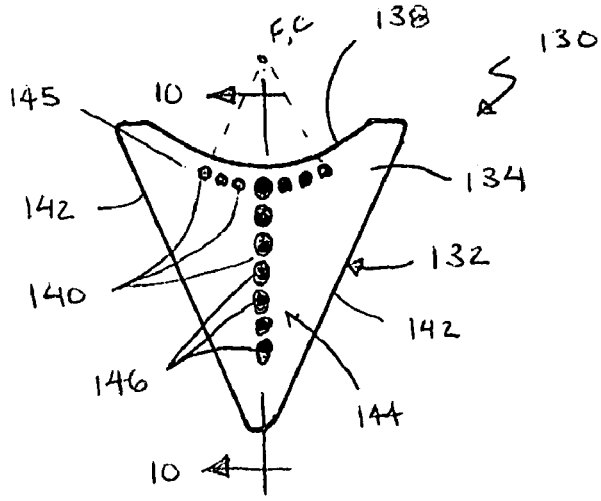
FIG. 9 is a top view of another embodiment of a golf ball marker of the present invention.
Figure 10:
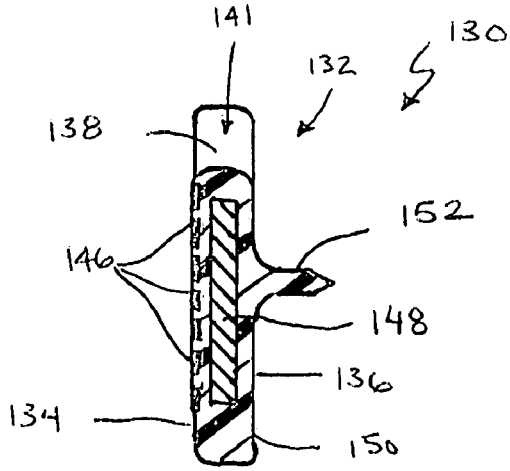
FIG. 10 is a cross-sectional view of the embodiment of FIG. 9 taken along line 10-10.

Referring to FIGS. 9 and 10, a ball marker 130 including a multi-material construction will be described. Marker 130 includes body 132 having a generally triangular shape that includes a top surface 134, a bottom surface 136, an arcuate ball location reference 138 and a plurality of alignment indicia 140. Body 132 has a thickness defined by a concave arcuate side wall 141 and a pair of planar side walls 142. Planar side walls 142 are angled relative to each other and coupled to each other at a first end. The second end of each planar side wall 142 is coupled to arcuate side wall 141 so that planar side walls 142 and arcuate side wall 141 combine to define the generally triangular perimeter shape of body 132. Concave arcuate side wall 141 is a generally cylindrical surface that is normal to and intersects top surface 134 and bottom surface 136 so that the intersection with top surface 134 forms a concave arcuate edge that is ball location reference 138. Preferably the radius of curvature of ball location reference 138 is in a range of 0.725 inch to 0.975 inch.

Body 132 has a multi-material construction that combines materials having different densities, such as by including one or more inserts. In particular, an insert 148 constructed of a material having a first density is coupled to a shell member 150 that is constructed of a material having a second density. In an embodiment, the first density is greater that the second density so that insert 148 acts as a weight member. For example, insert 148 may be constructed from a relatively heavy material such as tungsten-nickel, or carbon steel, and it may be co-molded with a polymeric material, such as polycarbonate. As a result, manufacturing could be simplified because shell member 150 may be injection molded in complex geometries over insert 148 having a non-complex geometry. Alternatively, the first density may be less than the second density so that insert 148 reduces the weight of a relatively heavy shell member 150.

A retainer 152 may also be included on ball marker 130 so that it remains in place after a user places it on the putting surface. Retainer 152 extends away from body 132 from bottom surface 136. Retainer 152 may be one or more tines, spikes, prongs or forks that are sized and shaped to extend into the putting surface. In the present embodiment, retainer 152 is a spike that extends from bottom surface 136 and includes a tapered distal end. The length of retainer 152 preferably is in a range of 0.125 inch to 0.500 inch.

Alignment indicia 140 include a generally elongate marking, comprising a plurality of linearly aligned and adjacent marks, that forms central indicium 144 and a plurality of adjacent reference indicia 145 that are located on top surface 134. In the present embodiment, central indicium 144 includes a plurality of aligned inlays 146. Reference indicia 145 are a plurality of dots or symbols that are spaced from ball location reference 138. In the present embodiment, reference indicia 145 are spaced from ball location reference 138 by a common distance so that reference indicia 145 are generally aligned in a curve and so that reference indicia 145 generally radiate from a focal point F (i.e., the distance between focal point F and the center of each indicium 145 is approximately the same) and focal point F is approximately coincident, or aligned vertically, with the center of curvature C of ball location reference 138.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

I claim:

1. A ball marker, comprising:

a body having a top surface, a bottom surface, a side wall extending between the top surface and the bottom surface, and a concave arcuate surface intersecting the top surface;

a concave arcuate ball location reference formed by the intersection of the concave arcuate surface and the top surface; and linear alignment indicia disposed on the top surface, perpendicular to the ball location reference, and spaced from the concave arcuate ball location reference by a common distance, wherein at least a plurality of the alignment indicia are identical and rotated relative to the next adjacent indicium, and consist of linear segments and each segment is perpendicular to the concave arcuate ball location reference so that the segments radiate from a focal point that is coincident with the center of curvature of the ball location reference.

2. The ball marker of claim 1, wherein the alignment indicia include at least one elongate indicium.

3. The ball marker of claim 2, wherein the elongate indicium comprises a plurality of aligned marks.

4. The ball marker of claim 2, wherein the elongate indicium is centrally located on the body.

5. The ball marker of claim 4, wherein the alignment indicia include at least one elongate indicium laterally spaced from and parallel to the centrally located indicium.

6. The ball marker of claim 1, wherein the concave arcuate ball location reference has a radius of curvature in the range of 0.725 inch to 0.975 inch.

7. The ball marker of claim 1, wherein the body has a perimeter shape that is one of a square, a rectangle and a triangle.

8. The ball marker of claim 1, wherein the body has a multi-material construction.

9. The ball marker of claim 8, wherein the body includes an insert made of a first material having a first density and a shell member made of a second material having a second density.

10. The ball marker of claim 9, wherein the insert is constructed of a metallic material and the shell member is constructed of a polymeric material.

11. The ball marker of claim 1, wherein the body includes a retainer extending from the bottom surface.

12. The ball marker of claim 1, wherein the retainer includes at least one projection extending from the bottom surface by a distance of 0.125 inch to 0.500 inch.

13. A ball marker, comprising:

a body having a top surface, a bottom surface, a side wall extending between the top surface and the bottom surface, and a concave arcuate surface intersecting the top surface;

a concave arcuate ball location reference formed by the intersection of the concave arcuate surface and the top surface; and linear alignment indicia disposed on the top surface, perpendicular to the ball location reference, and angled relative to each other and including at least one elongate indicium, wherein at least a plurality of the alignment indicia are identical and consist of linear segments and each segment is perpendicular to the concave arcuate ball location reference so that the segments radiate from a focal point that is coincident with the center of curvature of the ball location reference.

14. The ball marker of claim 13, wherein the elongate indicium comprises a plurality of aligned marks.

15. The ball marker of claim 14, wherein the plurality of aligned marks include at least one of an arrowhead, a star, an asterisk, a dash, a chevron and a dot.

16. A ball marker, comprising:

a body having a top surface, a bottom surface, a side wall extending between the top surface and the bottom surface, and a concave arcuate surface intersecting the top surface, wherein the body includes an insert made of a first material having a first density and a shell member coupled to the insert, the shell member made of a second material having a second density;

a concave arcuate ball location reference formed by the intersection of the concave arcuate surface and the top surface; and linear alignment indicia disposed on the top surface, perpendicular to the ball location reference, and angled relative to each other, wherein at least a plurality of the alignment indicia are identical and consist of linear segments and each segment is perpendicular to the concave arcuate ball location reference so that the segments radiate from a focal point that is coincident with the center of curvature of the ball location reference.

17. The ball marker of claim 16, wherein the insert is constructed of a metallic material and the shell member is constructed of a polymeric material.

18. The ball marker of claim 16, wherein the first density is greater than the second density.

* * * * *